United States Patent [19]

Ibrahim

[11] Patent Number: 4,684,441

[45] Date of Patent: Aug. 4, 1987

[54] A METHOD FOR OPERABLY ADJUSTING A LEADING, FORMING BOARD STRIP

[75] Inventor: Ahmed A. Ibrahim, Westerville, Ohio

[73] Assignee: Papyrus Inc., Westerville, Ohio

[21] Appl. No.: 883,729

[22] Filed: Jul. 9, 1986

[51] Int. Cl.[4] ..... D21F 1/54; D21F 7/00

[52] U.S. Cl. ..... 162/198; 162/208; 162/211; 162/252; 162/259; 162/352

[58] Field of Search ..... 162/301, 352, 354, 274, 162/259, 252, 198, 211, 212, 208, 210, 308, 310, 312

[56] References Cited

U.S. PATENT DOCUMENTS

| | | | |
|---|---|---|---|
| 3,201,308 | 8/1965 | Goodard et al. | 162/352 |
| 3,497,420 | 2/1970 | Clark | 162/352 |
| 3,520,775 | 7/1970 | Truya | 162/352 |
| 3,585,105 | 6/1971 | Stucbc | 162/352 |
| 4,038,193 | 7/1977 | Oosten | 162/351 |
| 4,319,957 | 3/1982 | Bartelmuss | 162/352 |
| 4,416,731 | 11/1983 | Pesunen et al. | 162/308 |
| 4,443,298 | 4/1984 | Thorp | 162/352 |
| 4,623,429 | 11/1986 | Tissari | 162/352 |

OTHER PUBLICATIONS

By Ahmed A. Ibrahim—*Computer-based Optimal Adjustment of Headboxes,* Apr., 1985—Southern Pulp & Paper.

By Ahmed A. Ibrahim—*Computer Analysis of Headbox/Slice Flow Dynamics,* Feb., 1985—PIMA Magazine.

By Ahmed A. Ibrahim—*Optimizing The Headbox with a Portable Computer: Part II,* Jun., 1985—PIMA Magazine.

*Primary Examiner*—Steve Alvo

*Attorney, Agent, or Firm*—Frank H. Foster

[57] ABSTRACT

A method for operably adjusting a leading strip of a forming board of papermaking wire wherein the position and length of an impinging papermaking slurry is detected and the length of the leading strip adjusted.

3 Claims, 9 Drawing Figures

METHOD FOR OPERABLY ADJUSTING A LEADING, FORMING BOARD STRIP

TECHNICAL FIELD

This invention relates generally to continuous, high volume, paper sheet forming machines and more particularly relates to improvements in the forming board of such machines which result in improved product uniformity and quality, enhanced fillers and fines retention, increased sheet opacity, less fiber stabling at the wire and reductions in sheet two-sidedness effect and wire mark.

BACKGROUND ART

In modern papermaking processes and machines the first part of the sheet forming operation is typically characterized by the provision of a headbox for directing a jet of papermaking slurry from the slice of the headbox and impinging it onto the upper surface of a porous wire which moves longitudinally along the production line. The wire moves over and is supported by a forming board which typically consists of a leading forming board strip followed by two or three downstream strips which are spaced from each other and spaced from the leading strip in order to permit water drainage. The slurry carries the fibers, fines and fillers onto the top of the rapidly moving wire and deposits them in a layer from which the water of the slurry is then drained. The forming board supports the wire generally in the region where the slurry impinges upon the wire.

The forming board, and particularly the first strip of the forming board, provides a support surface immediately beneath the wire to gently retain the slurry which impinges upon the wire, which at the leading strip has no fiber mat built up upon it. The leading strip aids the retention of the fiber mat on the wire. This allows an initial fiber mat to be created which further aids in the retention of fibers, fines and fillers to form a high quality sheet. As the wire progresses along the forming board and subsequent foils, drainage and doctoring of water from beneath the wire occur. It is therefore no exaggeration to say that the interaction of the fiber and fines particles in the few seconds or fractions of a second of the forming process is the very heart of papermaking.

Unfortunately, however, the forming boards of modern papermaking machines are adjustable only upon initial installation or when the machine is not operating. They are typically mounted by bolts which are accessible but do not permit adjustment of the forming board position during the dynamic operation of the machine in paper production.

Commonly, adjustments and other changes in the machine and process parameters occur as the paper mill manufactures paper to different product specifications or with different slurries. For example, the stock thickness at the slice or the slice opening may be varied or the jet angle may be modified depending on the bottom lip/upper slice geometry. Since the slurry jet which is emitted from the slice obeys conventional laws of fluid flow physics and more particularly the fundamental principles of jet trajectory, I have observed that variations in such parameters cause both the position at which the jet intercepts the wire and the longitudinal length of the jet intercept,longitudinally of the production line, to vary. The result has been that changes in the position and length of the intercept cause variations in product quality and uniformity.

For example, if the production process rate is increased, the speed of the wire must be increased and therefore the jet velocity must be increased so that the fibers of the slurry arrive on the wire at approximately the wire speed. However, increased jet velocity, which is required to deliver stock at a higher rate to the wire, causes the jet impingement points to occur further from the slice at a given predetermined angle. The longitudinal length of the intercept also varies because the angle of impingement varies and the slice opening varies too.

BRIEF DISCLOSURE OF INVENTION

In the present invention the top surface of the leading forming board strip is constructed so that its longitudinal length may be variably adjusted. Furthermore, it is made adjustably variable on the fly, that is so that it can be adjusted from a remote position during operation of the papermaking machine. Additionally, the position of the forming board leading strip with respect to the slice bottom lip is also made longitudinally adjustable from a remote position so that it can be moved during operation of the papermaking process. The result is that the position and length of the intercept can be detected, either by calculation based upon the parameters of the process or by measurement. The leading edge of the leading strip is positioned downstream of the initial impingement point of the intercept and by approximately 5% to 10% of the intercept length and the lagging edge of the leading strip is adjusted to approximately the downstream impingement point of the jet.

It is therefore a principal feature and advantage of the present invention that variations or adjustments in the parameters of the papermaking machine can be compensated for by adjusting the length and the position of the leading forming board strip to improve the quality of the sheet which is formed over the quality resulting from the present operation of paper forming machines.

Figure 1:
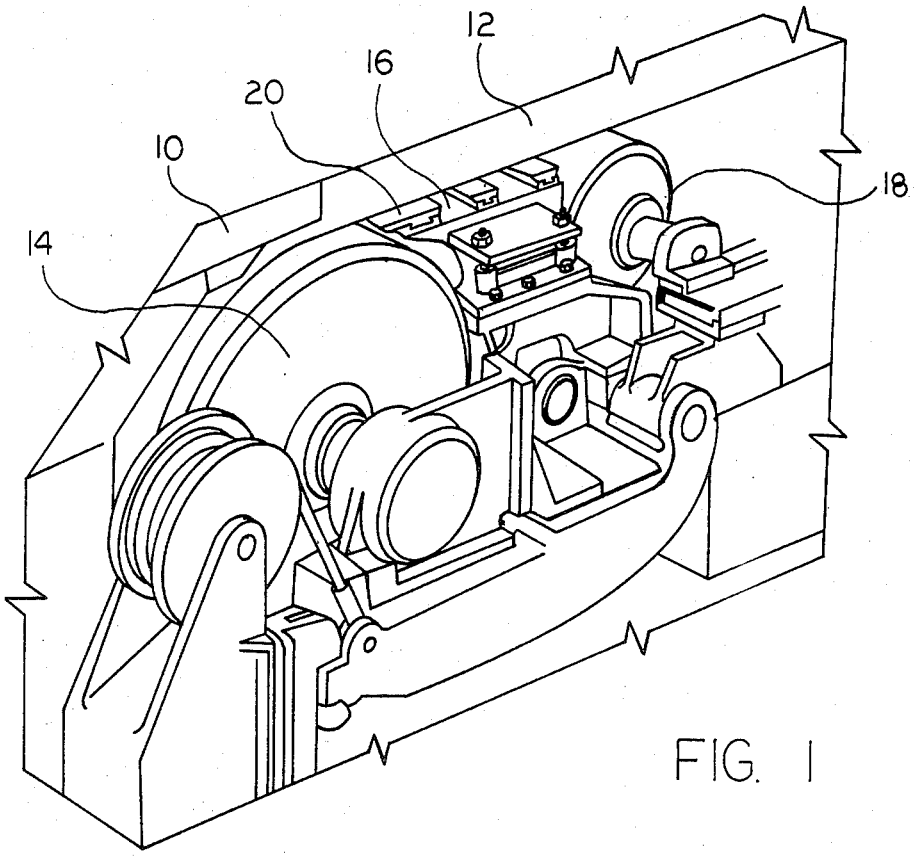
FIG. 1 illustrates a conventional forming board installation.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

FIG. 1 illustrates a typical forming board installation in which the headbox 10 is positioned above the wire 12 which is travelling away from the headbox and extends around the breast roll 14. The wire extends over and is supported by the forming board 16 and passes over the table roll 18. Under ideal conditions the jet which emerges from the headbox 10 impinges directly upon the leading strip 20 of the forming board 16.

Figure 2:
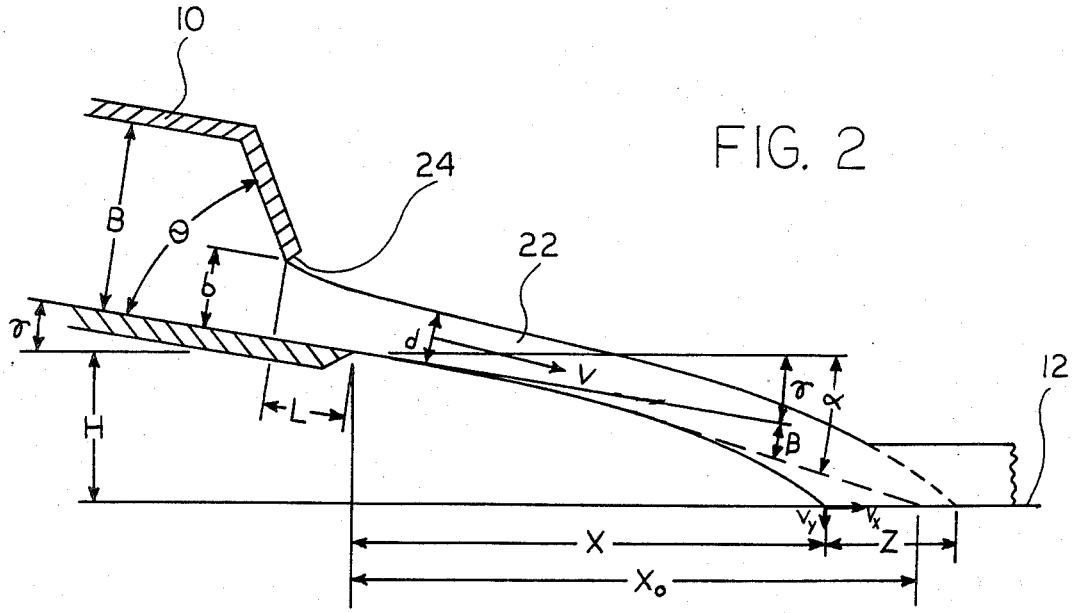
FIG. 2 is a diagram illustrating the most important parameters in determining the jet trajectory and its intercept with the wire.

FIG. 2 illustrates the most important machine and jet parameters associated with the jet trajectory. The parameters are defined in the following table:

| PARAMETER DEFINITIONS | |
|---|---|
| b = | Slice opening |
| d = | Jet thickness at vena contracta |
| B = | Stock thickness at slice. |
| H = | Height of the lower lip edge above the wire |
| L = | Lower lip extension beyond upper lip edge |
| X = | Jet impingement point relative to lower lip edge |
| $X_o$ = | Jet impingement point relative to lower lip edge in the absence of gravity |
| Z = | Jet-wire intercept length in the absence of a stock on the wire |
| $\alpha$ = | Jet angle to the horizontal |
| $\beta$ = | Jet angle relative to the lower slice plate |
| $\gamma$ = | Angle of lower slice plate relative to the horizontal |
| $\theta$ = | Slice angle |
| V = | Jet velocity at vena contracta |
| $V_x$ = | Horizontal component of jet impingement velocity |
| $V_Y$ = | Vertical component of jet impingement velocity |
| $C_c$ = | Contraction coefficient |

An explanation of the physics used to analyze the jet trajectory 22 is given in various textbooks, including pages 88–96 of UNIVERSITY PHYSICS Sixth Edition, published by Addison-Wesley Publishing Company. Other texts include *Schaum's Outline Of Theory And Problems Of Applied Physics* by Arthur Beiser, Ph.D., published by McGraw-Hill Book Company, *Schaum's Outline Of Theory And Problems Of College Physics* Seventh Edition, published by McGraw-Hill Book Company, and *Fundamental Formulas Of Physics,* published by Dover Publications, Inc.

The jet 22 emerges from the slice 24 of the headbox 10 at a velocity which is a function of the total pressure head inside the headbox 10. This total pressure head is the sum of the static and the velocity head of the flow.

The jet contracts to a minimum thickness of d at the vena contracta at approximately a distance b downstream from the top of the slice. In accordance with conventional physics, this is the point at which all of the slurry pressure is converted into velocity energy based on Bernoulli's priniciple. The amount of this contraction is a function of the headbox slice angle, the ratio b/B and the ratio L/b.

The horizontal component of the jet velocity remains constant along the trajectory, however, the vertical component is affected by gravity and increases during the flow along the trajectory. The jet impinges the wire at a distance from the headbox which is a function of the jet angle, the jet speed and the height H of the bottom lip of the slice above the wire 12.

The jet velocity is not the velocity of the slice but rather is the velocity in the vena contracta. The stock flow rate through the headbox is determined by the slice width, the jet velocity and the thickness d of the jet at the vena contracta.

The horizontal component of the jet velocity $V_x$, which is the velocity which is ideally equal to the wire velocity, depends upon the jet angle and the velocity d of the jet at the vena contracta.

The total pressure head inside the headbox is calculated to produce the correct jet velocity at the desired jet/wire speed ratio. The velocity head at the headbox sensor inside the headbox must be taken into account, especially in hydraulic headboxes as well as high flow rates in high speed machines to derive the net static head inside the headbox.

It is desirable that the jet travel the shortest distance possible from the slice to its intercept with the wire at the forming board in order to minimize jet wobbling. It is also desirable that the jet have a low vertical component of velocity at the impingement. Therefore, the height of the lower lip of the slice should be as low as possible above the wire and should be uniform laterally across the width of the wire. The jet should land on the forming board with a sealing effect at its leading edge and uniformly across its width in order to eliminate the effect of slurry back flow and prevent air from seeping underneath the jet where it lands upon the wire. Therefore, the net static pressure head in the headbox should be maintained so that the wire travels slightly faster than the horizontal jet velocity in order to avoid back flows or fluctuations in mass deposited upon the wire.

If wire speed is to be changed or stock consistency changes, the position and width of the intercept of the jet with the wire will similarly change.

It can be seen that as the jet angle is decreased or the height of the lower lip above the wire is increased, the impingement point increases. Further, as wire speed is increased the jet velocity must be correspondingly increased and this also causes an increase in the intercept position. Furthermore, if the jet angle and/or the slice opening is changed the jet length will vary too.

The vertical component of jet velocity is decreased as the jet angle is reduced and increases at higher machine speeds.

Unfortunately, those parameter conditions under which the desirable low vertical velocity component is obtained are opposite to the conditions under which the desirable short jet travel distance is obtained. As the jet angle is increased the jet impingement point is decreased, but the vertical velocity component is also increased. Similarly, as the jet angle is decreased the vertical velocity component decreases, but the jet impingement point moves further from the slice. Thus, optimum intermediate conditions must be selected. However, when they are selected, the present invention permits the leading forming board strip to be adjusted to the detected or determined position.

This location or position of the forming board is determined by measurement of the parameters and the calculation using the principles of physics, or, alternatively, the intercept location can be measured. In response, the leading strip of the forming board is then moved to that location.

Using the same principles, the length Z of the intercept is also detected. The length of the leading forming board strip is then adjusted to provide for support of the jet as it lands upon the wire. This achieves improvements in the retention of fillers and fines, improves the sheet formation, improves product uniformity to reduce flaws, such as streaks in the final product, decreases the porosity of the sheet and enhances its free release from the wire at couch and wet presses.

Therefore, by positioning the leading strip of the forming board at the right position and by adjusting it to the right length to properly support the wire and the slurry deposited upon it at the intercept, the probability of the retention of the slurry born materials rapidly increases.

Figure 3:
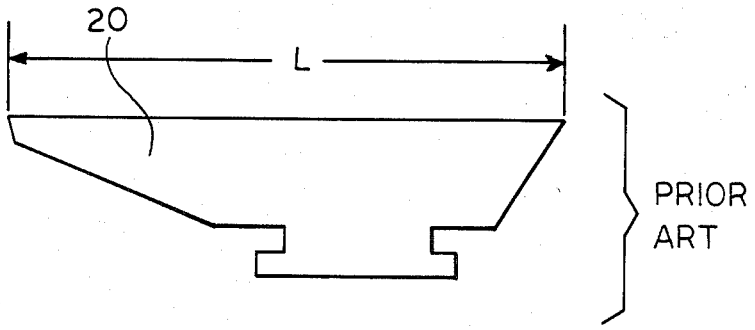
FIG. 3 is an end view of a conventional leading strip of a conventional forming board.

FIG. 3 illustrates a conventional leading forming board strip 20. It is mounted on the forming board and is a single unit having a length L which is not adjustable.

Figure 4:
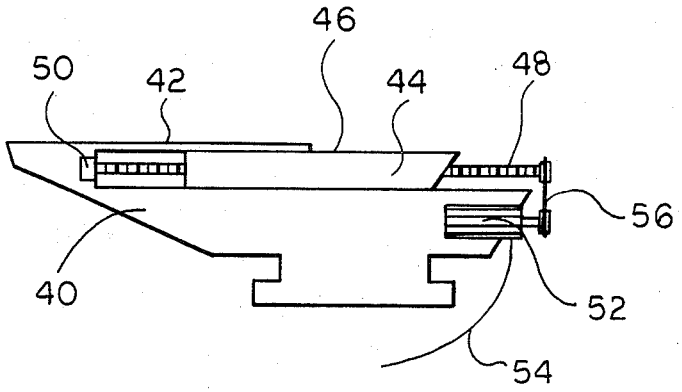
FIG. 4 is an end view illustrating a leading forming board strip which is a preferred embodiment of the present invention for varying the length of the forming board strip during operation of the papermaking machine.

FIG. 4 illustrates a leading forming board strip which has an adjustable length embodying the present invention. The embodiment of FIG. 4 has a principal body 40. The body 40 has a relatively thin upper sheet 42 which serves as a portion of the top surface of the leading strip. A platform 44 having an upwardly facing surface 46, which also forms a portion of the upper surface of the leading strip, is slidably mounted relative to the thin sheet 42 for adjustable longitudinal reciprocation. Thus, the upper surface of the thin sheet 42 and the upperwardly facing surface of the platform 44 are longitudinally adjusting reciprocatable.

A variety of mechanical linkages for linking the sliding platform 44 to a remote control location will be apparent to those skilled in the art. It may, for example, consist of a threaded rod 48 journalled to a thrust bearing 50 and threadedly engaged to a bore through the platform 44 so that rotation of the threaded rod 48 will translate the platform 44 forward and aft as desired. The rod may be rotated, for adjusting the effective length of the top surface of the leading strip, by a variety of mechanical linkages such as, for example, a small electric motor 52 linked to a control system by a wire 54 and drivingly connected to the threaded rod 48 by means of a pulley and belt system 56.

Figure 5:
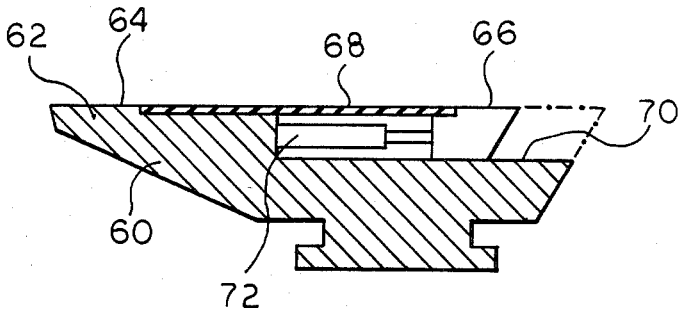
FIG. 5 is an alternative structure embodying the present invention for varying the length of the forming board strip during operation of the papermaking machine.

FIG. 5 illustrates yet another embodiment of the present invention for adjusting the length of the leading strip of the forming board. This embodiment has a main body 60, including a longitudinally forward segment 62 having an upper surface 64, a longitudinally aft segment 66 and an elastic intermediate segment 68. The intermediate segment 68 is fixed to and extends between the top of the forward segment 62 and the aft segment 66.

The aft segment 66 slides upon a lower surface 70 on the main body 60 and is driven reciprocatingly by a small hydraulic cylinder 72. The intermediate segment 68 is made of a conventional elastic material so that it may be pulled and stretched as the aft sgement 66 is driven rearwardly by the hydraulic cylinder 72, for example, to the position illustrated in phantom providing a greater longitudinal length for the top surface of the leading forming board strip.

Figure 6:
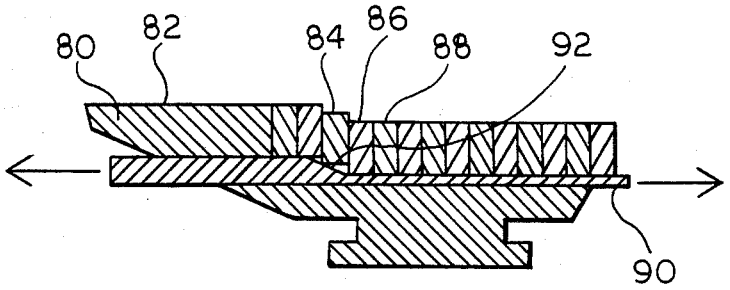
FIG. 6 is yet another alternative structure embodying the present invention for varying the length of the forming board strip during operation of the papermaking machine.

FIG. 6 illustrates yet another alternative embodiment wherein the leading strip comprises a main body 80 having a forward, first platform 82 and a plurality of discrete platform extensions such as 84, 86 and 88. The platform extensions are movably mounted so that a selected number of these extensions can be moved vertically in series longitudinally adjacent to the first platform 82. This may be accomplished, for example, by a sliding bar 90 having an upper cam surface with each of the platform extensions in cam relationship to the cam surface. An inclined cam surface 92 on the bar 90 forces the extensions upwardly so that their upper surfaces are in flush engagement with the first platform 82 to effectively extend the length of the leading strip as the sliding bar is slid aft.

Figure 7:
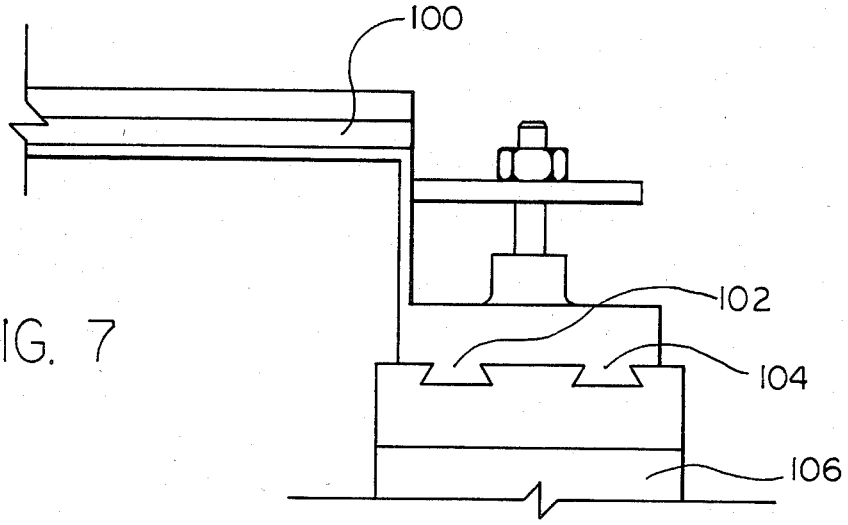
FIG. 7 is a view in front elevation of a portion of a forming board embodying the present invention illustrating means for varying the position of the forming board.
Figure 8:
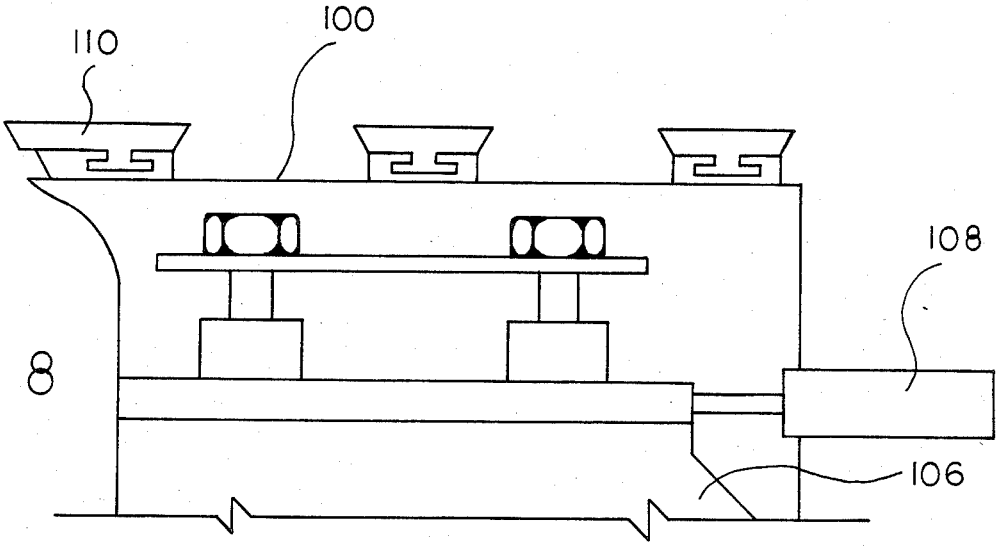
FIG. 8 is a view in side elevation of the embodiment illustrated in FIG. 7.

FIGS. 7 and 8 illustrate means for adjusting the longitudinal position of the forming board. In this embodiment the forming board assembly 100 is mounted, by means of sliding dove tails 102 and 104, to the main body of the machine 106. It is longitudinally moved by means of a hydraulic cylinder 108 connected to the forming board assembly and positioned by means of a conventional hydraulic control system. The leading forming board strip 110 of the forming board assembly 100 is constructed in accordance with an embodiment of the invention, such as one of the embodiments of FIGS. 4–6.

With such structures, the length of the leading forming board strip is adjusted to at least 80% of the length Z of the intercept and preferably to about 90% to 95% of that length. This permits the intercept to extend forwardly of the leading edge of the leading strip of the forming board by 5% to 10% of its length, for example, so that there is no back flow of the slurry upstream of the process and to inhibit the entrance of air into the jet before it strikes the forming board strip.

Figure 9:
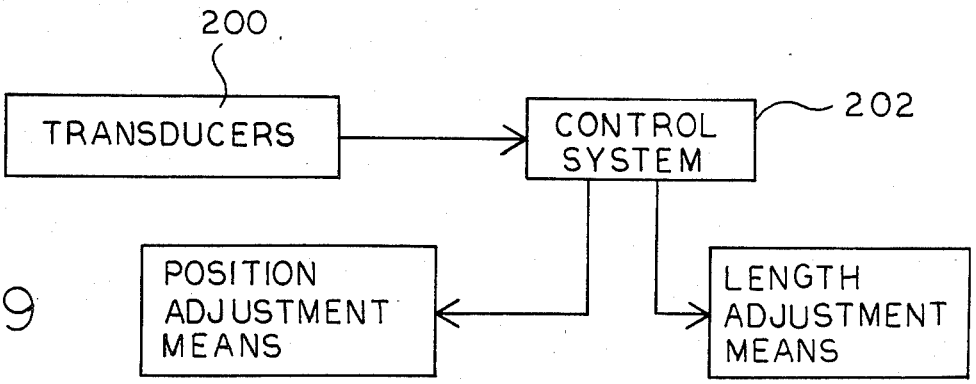
FIG. 9 is a block diagram illustrating a control system for automatically adjusting the position and the length of the forming board in accordance with the present invention.

As described above, the position and the effective length of the leading strip of the forming board are detected and then the leading strip is manually adjusted in the manner described. Alternatively, however, a control means may be used to automatically accomplish the same result. With such a system a plurality of transducers 200 are mounted in the papermaking machine for detecting the position and length of the intercept of the jet as shown in FIG. 9. The signals from these transducers 200 are applied to a control system 202 which, using conventional means such as feedback control systems, adjusts the longitudinal position of the leading strip of the forming board and the length of the forming board.

The transducers 200 and the control system 202 may operate under either of two alternative systems. The transducers may detect the actual position of the jet intercept and its length utilizing a plurality of conventional flow detection transducers.

In the alternative, the transducers can detect the parameters illustrated in FIG. 2 and the control system may include a digital computer to compute the position and length of the jet intercept using the principles of physics referred to above.

While certain preferred embodiments of the present invention have been disclosed in detail, it is to be understood that various modifications may be adopted without departing from the spirit of the invention or scope of the following claims.

I claim:

1. A method for operably adjusting the forming board of a paper making apparatus of the type having a headbox for impinging a jet of papermaking slurry from its slice onto the upper surface of a wire moving longitudinally over and supported by a forming board which includes a leading, forming board strip, said method comprising:

(a) detecting the position and length of the intercept of the jet with the wire during dynamic operation of the papermaking apparatus;

(b) positioning the leading strip of the forming board at said intercept; and (c) adjusting the length of said leading strip of the forming board in the direction of travel of the wire to substantially 90%-95% of the length of said intercept, wherein the intercept extends forwardly of a leading edge of the leading strip.

2. A method in accordance with claim 1 wherein said position and said length are calculated using the physical parameters of said papermaking apparatus and computing said length and position using fluid trajectory algorithms.

3. A method in accordance with claim 1 or 2 wherein said length and position are dynamically adjusted during operation of the papermaking machine.

* * * * *